US008100780B1

(12) United States Patent
Chol

(10) Patent No.: US 8,100,780 B1
(45) Date of Patent: Jan. 24, 2012

(54) ADJUSTABLE LENGTH AND TORQUE RESISTANT GOLF SHAFT

(76) Inventor: Kim Chol, San Jose, CA (US)

( * ) Notice: Subject to any disclaimer, the term of this patent is extended or adjusted under 35 U.S.C. 154(b) by 0 days.

(21) Appl. No.: 13/176,161

(22) Filed: Jul. 5, 2011

(51) Int. Cl.
*A63B 53/16* (2006.01)

(52) U.S. Cl. ..... 473/296; 403/377

(58) Field of Classification Search ..... 473/239, 473/296, 298–299, 376, 377; 403/109.1–109.8, 403/297, 379.4, 379.5, 367
See application file for complete search history.

(56) References Cited

U.S. PATENT DOCUMENTS

| | | | | | |
|---|---|---|---|---|---|
| 1,648,806 | A | | 5/1927 | Hadden | |
| 2,107,983 | A | | 2/1938 | Hamilton | |
| 2,475,927 | A | | 7/1949 | Verderber | |
| 5,083,779 | A | * | 1/1992 | Ungermann | 473/239 |
| 5,282,619 | A | * | 2/1994 | Napolitano et al. | 473/239 |
| 5,452,891 | A | | 9/1995 | Thomas | |
| D363,519 | S | | 10/1995 | Gooden | |
| 5,496,029 | A | * | 3/1996 | Heath et al. | 473/296 |
| 5,653,644 | A | | 8/1997 | Jaeckel | |
| 5,679,080 | A | | 10/1997 | Finsterwald | |
| 6,776,724 | B1 | | 8/2004 | Siemsglusz | |
| 6,875,123 | B2 | * | 4/2005 | Wilson | 473/239 |
| 7,018,302 | B2 | | 3/2006 | Jacoby | |
| 7,074,135 | B2 | * | 7/2006 | Moore | 473/296 |
| 7,264,556 | B1 | * | 9/2007 | Divisconti | 473/296 |
| 7,422,526 | B2 | | 9/2008 | Nemeckay | |
| 7,424,833 | B2 | * | 9/2008 | Fich et al. | 74/89.35 |
| 2002/0091012 | A1 | | 7/2002 | Evans | |
| 2003/0083144 | A1 | * | 5/2003 | Shin | 473/296 |
| 2006/0028039 | A1 | | 2/2006 | Ernesti | |
| 2011/0081983 | A1 | * | 4/2011 | Johnson | 473/288 |

* cited by examiner

*Primary Examiner* — Stephen L. Blau
(74) *Attorney, Agent, or Firm* — Patent Office of Dr. Chung S. Park

(57) ABSTRACT

An adjustable golf shaft having an upper shaft member, a lower shaft member, and a locking mechanism to hold the upper shaft member in place relative to the lower shaft member. The upper shaft member has an elongated bore therein and the lower shaft member has a cylinder and a rod having one end fixed to a proximal end of the cylinder. A fixed bushing is positioned within the elongated bore of the upper shaft member and has an elongated bore extending therethrough and a groove. The locking mechanism includes a pin that has a tapered tip configured to engage into the groove.

7 Claims, 4 Drawing Sheets

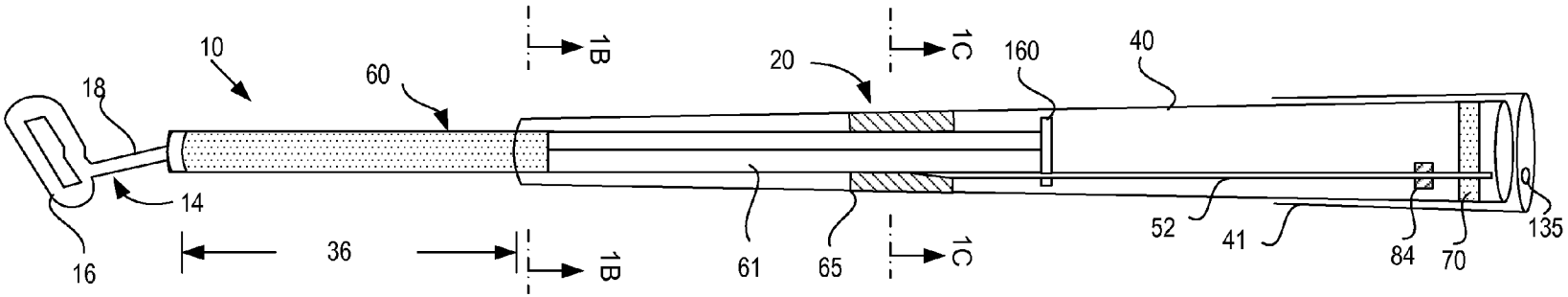
FIG. 1A
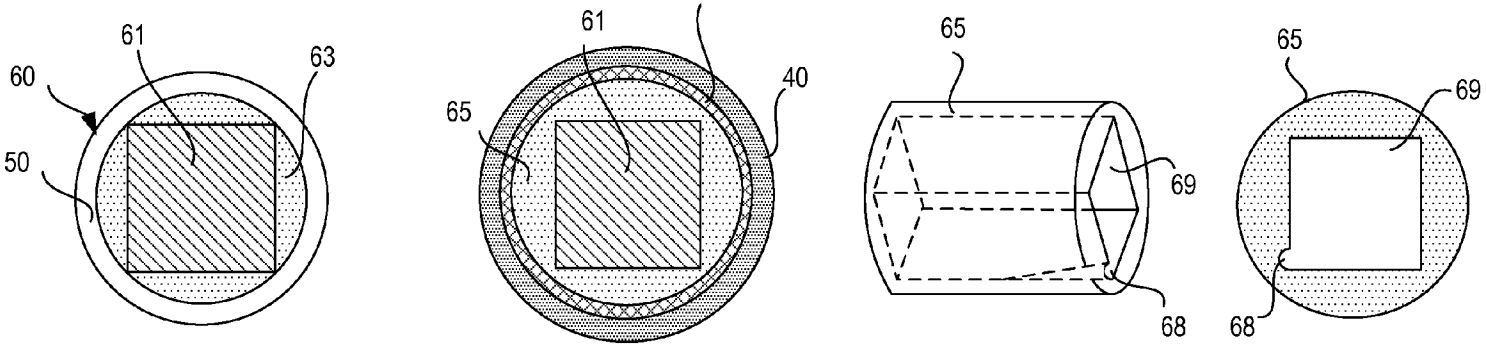
FIG. 1B
FIG. 1C
FIG. 1D
FIG. 1E

ADJUSTABLE LENGTH AND TORQUE RESISTANT GOLF SHAFT

FIELD OF INVENTION

This invention relates to an adjustable golf shaft and more particularly to an adjustable length and torque resistant golf shaft having a locking mechanism.

BACKGROUND

The sport of golf is an increasingly popular sport. Much of the tension, and excitement, of any round of golf, surrounds the act of putting, which ordinarily determines the ultimate winner of any round of golf. As a result of its obvious importance to successfully playing the game of golf, the art, or skill, of putting has been the subject of large numbers of instruction manuals, books, magazine articles, and United States patents. A casual observation of professional and amateur golfers, in the acts of putting shows that putting style, including putter grip, player's stance, putter club style, ball position, can be different for each golfer.

In addition, it can be appreciated that physically, every golfer varies greatly in height, weight, and body structure, such that the distance and angle between the ground and the golfer's hands when putting can also vary greatly. Generally speaking, the act of putting does not require unusual strength, or extremely high velocity club swinging, as in the case of driving or iron play. Putting is, rather, an act of finesse and, hopefully, an act as free of physical stress and mental swing correction signals as possible.

Golf clubs available for purchase at most sports stores are readily available in varying degrees of shaft flex and club head shape. The length of the woods and irons of a set of golf clubs are usually approximately standard throughout the golf manufacturing industry, although such clubs may be special ordered with non-standard lengths. Most golfers, however, acquire a standard length set of clubs and modify their stance, grip, and other swing characteristics to optimize their swing action relative to those clubs.

The design of putters is typically viewed as a pursuit of an aesthetically pleasing club that promotes a golfer's confidence in his or her stroke. As such, many putters have been designed irrespective of the mechanics inherent in the putting swing. Furthermore, many putters lack a design that accounts for an individual golfer's characteristics and characteristic playing style (i.e., stance, grip, etc.).

In the case of putters, conventional practice is to provide putters having an overall length of generally about 35", and a conventional lie angle between the shaft and the bottom surface of the putter of approximating 70 degrees. Rarely are putters shortened or lengthened, and typically, the beginner, or intermediate, golfer will adapt his putter swing to the length of the club rather than having a putter personally fitted to him, or her, without any reference to the standard length or lie.

Accordingly, it would be desirable to have a putter with an adjustable length and torque resistant golf shaft, which can easily adjust to various heights and has the appearance of a conventional shaft whose configuration is fixed.

SUMMARY

In accordance with one embodiment, an adjustable golf shaft includes: an upper shaft member having an elongated bore therein with a fixed bushing positioned within the elongated bore therein, the bushing having an elongated bore extending therethrough and a groove; a lower shaft member having a cylinder and a rod having one end fixed to a proximal end of the cylinder, the rod being slidably mounted through the elongated bore of the bushing; and a locking mechanism including a pin, the pin having a tapered tip configured to engage into the groove.

BRIEF DESCRIPTION OF THE DRAWINGS

FIG. 1A is a cross sectional view of an adjustable length and torque resistant golf shaft according to one embodiment.

FIGS. 1B and 1C are cross sectional views of the adjustable length and torque resistant golf shaft in FIG. 1A, taken along the directions 1B and 1C, respectively.

FIG. 1D is a perspective view of the bushing of the golf shaft in FIG. 1A.

FIG. 1E is a side view of the bushing in FIG. 1D.

DETAILED DESCRIPTION

Figure 2:
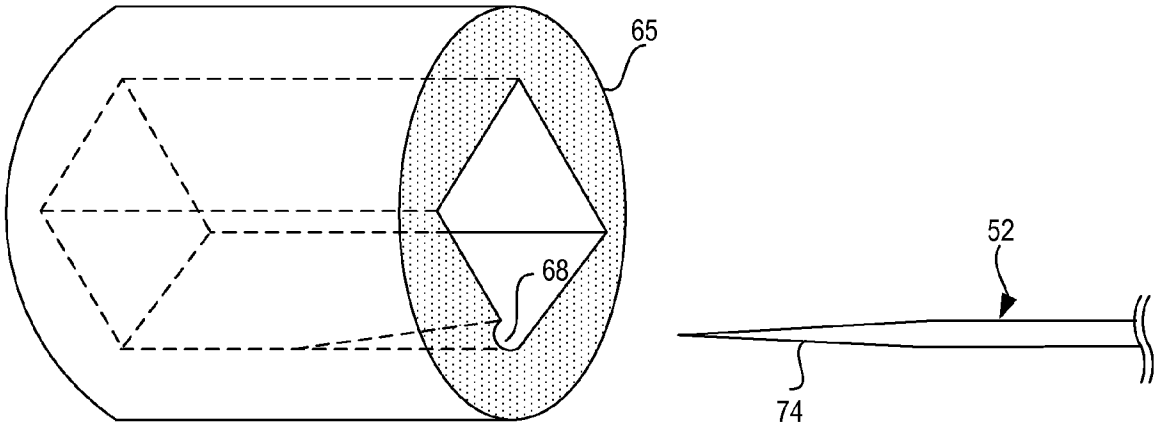
FIG. 2 is an exploded view of the bushing and the tapered tip of the pin in FIG. 1A.

FIG. 1 is a cross sectional view of a putter 10 having an adjustable length and torque resistant golf shaft 20 according to one embodiment. FIGS. 1B and 1C are cross sectional views of the adjustable length and torque resistant golf shaft 20 in FIG. 1A, taken along the directions 1B and 1C, respectively. As shown in FIGS. 1A-1C, the putter 10 includes an adjustable shaft 20, which is comprised of an upper shaft member 40 (or outer shaft member), a lower shaft member 60 (or inner shaft member), and a bushing 65. The bushing 65 is secured to the inner surface of the upper shaft member 40 by a suitable fixing member 67 (preferably, glue). The grip 41 is configured to fit over an upper end of the upper shaft member 40 and extends downward approximately 8 to 14 inches. The lower shaft member 60 includes: a hollow cylinder 50; an inner rod (or, shortly rod, hereinafter) 61 that is fixed to one end of the hollow cylinder 50 by a suitable fixing member 63 (preferably, glue); and, optionally, a rod stop 160 that is fixed to one end of the rod 61 by a suitable fixing mechanism (preferably glue). The rod stop 160 prevents the rod 61 from disengaging entirely from the bushing 65 when the user pulls out the lower shaft member 60. A putter head 14 including a striking portion 16 and a shaft 18 is attached to the other end of the hollow cylinder 50.

FIG. 1D is a perspective view of the bushing 65 of the putter 10 in FIG. 1A. FIG. 1E is a side view of the busing 65 in FIG. 1D. As depicted, the bushing 65 is generally cylindrical in shape and has an opening or bore 69 extending from one end to the other end of the bushing and a wedge-shaped groove 68, where the rod 61 snuggly fits into the opening or bore 69. The cross section of the rod 61 is dimensioned to slide through the bore 69 when the player of the putter 10 adjusts the overall length of the putter 10 by pulling or pushing the upper shaft member 40 relative to the lower shaft member 60, i.e., the lower shaft member 60 telescopes inward or outward from the upper shaft member 40. In one embodiment, the cross section of the rod 61 is dimensioned to hold the rod 61 in place relative to the bushing 65 by the frictional force between the rod 61 and the bushing 65 when the user plays the golf with the putter 10. In another embodiment, the cross section of the rod 61 is dimensioned so that the frictional force between to rod 61 and the bushing 65 is not strong enough to hold the rod 61 in place relative to the bushing 65 when the user plays the golf with the putter 10. In both embodiments, a locking mechanism is used to hold the rod 61 in place relative to the bushing 65 when the user plays the golf with the putter 10. The locking mechanism is described in detail in conjunction with FIGS. 2-3B.

The rod 61 may be formed of suitable material, such as aluminum, brass, or steel. The bushing 65 may be formed of any suitable material, such as polyurethane, plastic, rubber, nylon, or acetal. The materials of the rod 61 and bushing 65 may be selected to stand the torque generated by the head 14.

The putter 10 preferably has an overall length of between about 27 and 37 inches. The overall length of the putter 10 when fully extended is approximately 37 inches. Meanwhile, the overall length of the putter in a compressed or compact position is preferably approximately 27 inches. Although, the preferable overall length of the putter 10 is between 27 and 37 inches, it can be appreciated that the overall length of the putter can range from 10 to 72 inches and is more preferably between 20 and 44 inches, and most preferably between 27 and 37 inches. The overall length of the putter 10 varies by a differential length 36 of preferably about 10 inches. It can be appreciated that the overall length of the putter 10 can vary and that any reference to specific measurements is for one embodiment of the present invention consisting of a putter 10 having an overall length of between 27 and 37 inches. However, it can be appreciated that the various dimensions, length, diameters and other specific references to any specific measurement can be changed without departing from the present invention.

FIG. 2 is an exploded view of the busing 65 and the tapered tip 74 of the pin 52 in FIG. 1A. FIG. 3A is a cross sectional view of a portion of the golf shaft 20 in FIG. 1A, where the pin 52 is in the locking position. As depicted, the locking mechanism 83 includes the pin 52, a stop 84 secured to the pin 52, a pin holder 70 secured to the inner surface of the upper shaft member 40 by a suitable fixing member (preferably glue), and the groove 68 formed in the bushing 65. The pin 52 includes a knob 80, a screw section 81, an elongated bar 85, and the tapered tip 74. The pin 52 may be formed of suitable material, such as aluminum, brass, or steel. The pin holder 70, which is formed of any suitable material, such as polyurethane, plastic, nylon, acetal, or metal, includes an internal thread (or, equivalently, female thread) configured to receive the screw section 81 of the pin 52.

When the user of the putter 10 wants to hold the bushing 65 in place relative to the rod 61 (i.e., the user intends to secure the pin 52 in the locking position), the user turns the knob 80 of the pin 52 so that the tapered tip 74 of the pin 52 is fully engaged into the groove 68. When the tapered tip 74 is fully engaged into the groove 68, the tapered tip 74 operates as a wedge that prevents the rod 61 from moving relative to the bushing 65.

The locking mechanism 83, once locked, prevents the rod 61 from moving relative to the bushing 65 when the user plays the golf with the putter 10. Thus, in the case where the frictional force between the rod 61 and the bushing 65 is not strong enough to hold the rod 61 in place relative to the bushing 65 when the user plays the golf with the putter 10, the locking mechanism 83 prevents the rod 61 from sliding relative to the bushing 65. Also, in the case where the friction force between the rod 61 and the bushing 65 is strong enough to hold the rod 61 in place relative to the bushing 65 when the user plays the golf with the putter 10, the locking mechanism 83 operates as an additional mechanism that prevents the rod 61 from inadvertently sliding relative to the bushing 65

Figure 3B:
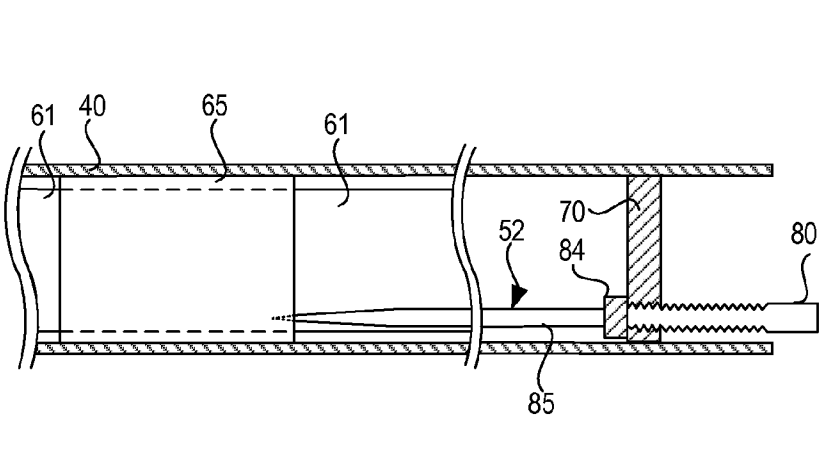
FIG. 3B is a cross sectional view of a portion of the golf shaft in FIG. 1A, where the locking mechanism is in the releasing position.
Figure 3A:
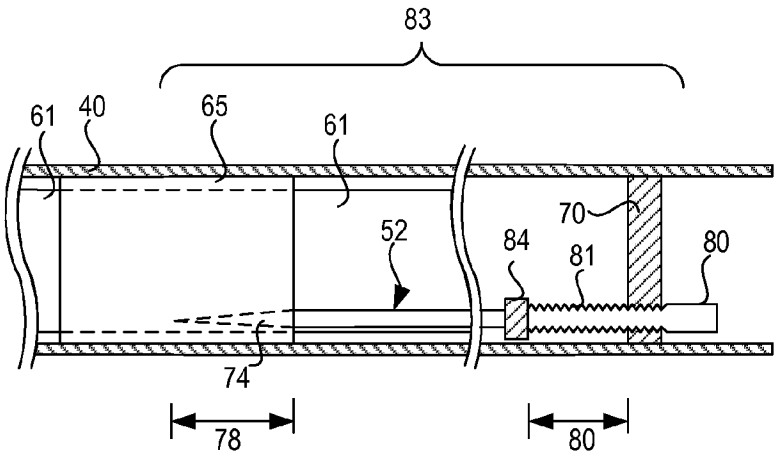
FIG. 3A is a cross sectional view of a portion of the golf shaft in FIG. 1A, where the locking mechanism is in the locking position.

FIG. 3B is a cross sectional view of a portion of the golf shaft 20 in FIG. 1A, where the pin 52 is in the releasing position. When the user wants to release the locking mechanism 83, he turns the knob 80 so that the tapered tip 74 is partially retrieved from the groove 68. As depicted, the maximum distance 80 between the stop 84 and the pin holder 70 is smaller than the length of the tapered tip 74 so that the tapered tip 74 is not fully disengaged from the groove 68 when the pin 52 is in the releasing position. It is noted that the bushing 65 and the pin holder 70 are fixed to the upper shaft member 40 by a suitable fixing mechanism, such as glue. For brevity, the glue is not shown in FIGS. 3A-3B.

Figure 4A:
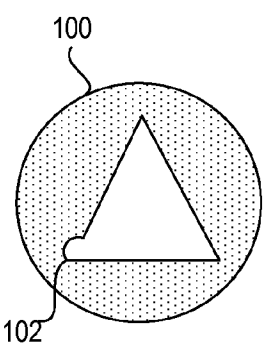
FIGS. 4A-4C are cross sectional views of a series of bushings adapted to receive inner rods having various cross sectional configurations.
Figure 4B:
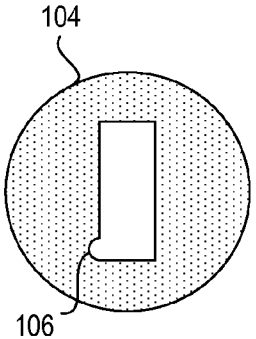
Figure 4C:
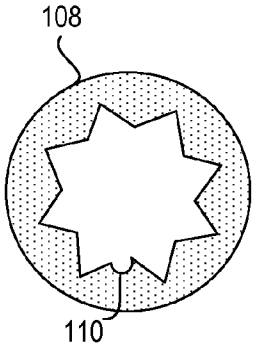
Figure 5A:
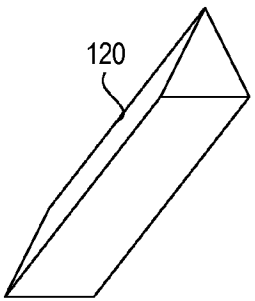
FIGS. 5A-5C are cross sectional views of a series of inner rods having various cross sectional configurations.
Figure 5B:
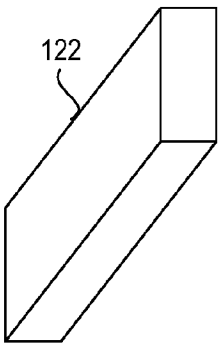
Figure 5C:
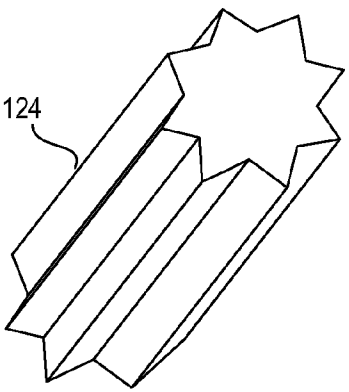

It should be apparent to those of ordinary skill that the rod 61 may have any suitable cross sectional shape other than square (shown in FIG. 1E). For example, FIGS. 4A-4C are cross sectional views of a series of bushings 100, 104, and 108 adapted to receive rods 120, 122, and 124 shown in FIGS. 5A-5C, respectively. As shown in FIGS. 4A-4C, it can be appreciated that the opening or bore within the bushings can have any suitable configuration to match those of the rods including triangle (FIG. 4A), rectangular (FIG. 4B), star (FIG. 4C). It is noted that the bushings 100, 104, and 108 have grooves 102, 106, and 110, respectively, for receiving the tapered tip 74 of the pin 52. The matching configurations of the rods and the bores prevent the rods from rotating relative to the bushing, to thereby form an anti-torquing or torque resistant mechanism.

Figure 6A:
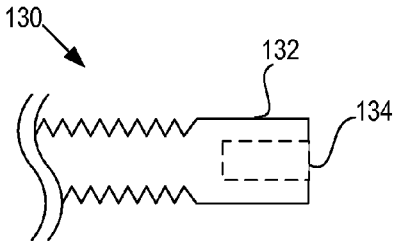
FIG. 6A is an enlarged view of the head portion of a pin according to another embodiment.
Figure 6B:
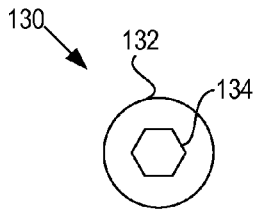
FIG. 6B is a side view of the pin in FIG. 6A.

FIG. 6A is an enlarged view of the head portion of a pin 130 according to another embodiment. FIG. 6B is a side view of the pin 130 in FIG. 6A. As depicted, the pin 130 includes a knob 132 that the user turns to lock/unlock the pin. Also, the pin 130 has a socket head 134 so that the user can use a hex key to turn the pin 132. The grip 41 may have a hole 135 (shown in FIG. 1) so that the user may insert the hex key therethough.

Figure 7:
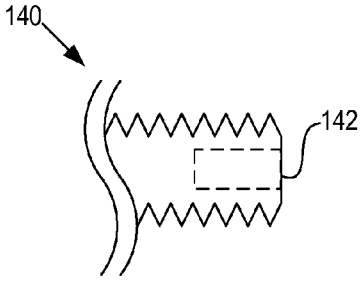
FIG. 7 is an enlarged view of the head portion of a pin according to yet another embodiment.

FIG. 7 is an enlarged view of the head portion of a pin 140 according to another embodiment. As depicted, the pin 140 does not have a knob. Instead, the pin 140 has a socket head 142 so that the user can use a hex key to turn the pin 140.

Figure 8:
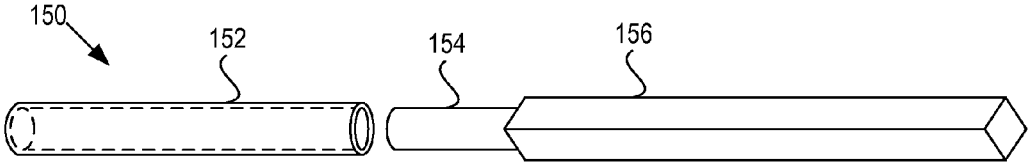
FIG. 8 is an exploded view of a lower shaft member according to another embodiment.

FIG. 8 is an exploded view of a lower shaft member 150 according to another embodiment. The lower shaft member 150 includes a hollow cylinder 152, an adaptor 154, and a rod 156. The adaptor 154 is engaged into and fixed to one end of the hollow cylinder 152 by a suitable fixing member (preferably, glue). The rod 156 may have a suitable cross sectional shape that matches to that of the bore or opening in the bushing, as described in conjunction with FIG. 4A-5C. For instance, the rod 156 may have a square shape, and the diagonal dimension of the square is larger than the outer diameter of the hollow cylinder 152. The adaptor 154 and the rod 156 may form an integral body, i.e., one end of the rod 156 may be machined to form the adaptor 154.

Figure 9A:
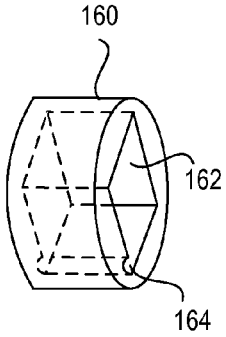
FIGS. 9A and 9B are perspective and side views of the rod stop in FIG. 1A, respectively.
Figure 9B:
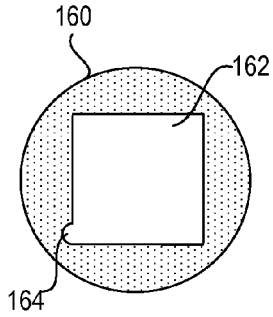

FIGS. 9A and 9B are perspective and side views of the rod stop 160 in FIG. 1A, respectively. As depicted, the rod stop 160 has a generally disk shape, an opening or bore 162 extending from one end to the other end thereof, and a groove 164. The rod 61 fits into the opening or bore 162 and fixed to the rod stop 160 by a suitable fixing mechanism, such as glue. The cross section of the groove 164 is dimensioned to allow the pin 52 to freely slide therethrough. It is noted that the rod stop 160 may other suitable cross sectional shape, such as square or rectangle.

It will be understood that the foregoing description is of the preferred embodiments, and is, therefore, merely representative of the article and methods of manufacturing the same. It can be appreciated that variations and modifications of the different embodiments in light of the above teachings will be readily apparent to those skilled in the art. Accordingly, the exemplary embodiments, as well as alternative embodiments, may be made without departing from the spirit and scope of the articles and methods as set forth in the attached claims.

What is claimed is:

1. An adjustable golf shaft comprising:

an upper shaft member having an elongated bore therein with a fixed bushing positioned within the elongated bore therein, the bushing having an elongated bore extending therethrough and a groove;

a lower shaft member having a cylinder and a rod having one end fixed to a proximal end of the cylinder; the rod being slidably mounted through the elongated bore of the bushing; and a locking mechanism including a pin, the pin having a tip configured to engage into the groove.

2. An adjustable golf shaft as recited in claim 1, wherein the locking mechanism further includes a pin holder having an internal thread formed therein and wherein the pin has a screw section configured to engage into the internal thread.

3. An adjustable golf shaft as recited in claim 1, wherein the locking mechanism further includes a stop secured to the pin and wherein the stop is configured to prevent the tip from being entirely disengaged from the groove.

4. An adjustable golf shaft as recited in claim 1, wherein the pin includes a socket head.

5. An adjustable golf shaft as recited in claim 1, wherein the pin includes a knob that a user of the golf shaft turns to move the pin relative to the bushing.

6. An adjustable golf shaft as recited in claim 1, wherein a cross section of the rod is square, triangle, rectangle, or star.

7. An adjustable golf shaft as recited in claim 1, wherein a lower shaft member includes a rod stop fixed to an other end of the rod.

* * * * *